United States Patent [19]

Schroder

[11] 4,311,890

[45] Jan. 19, 1982

[54] HIGH-VOLTAGE, BLAST-ACTUATED POWER SWITCH HAVING A DEFORMABLE BRIDGE CONDUCTOR

[75] Inventor: Gunther Schroder, Birmenstorf, Switzerland

[73] Assignee: BBC Brown, Boveri & Company, Limited, Baden, Switzerland

[21] Appl. No.: 112,315

[22] Filed: Jan. 15, 1980

[30] Foreign Application Priority Data

Feb. 15, 1979 [CH] Switzerland ..... 1497/79

[51] Int. Cl.[3] ..... H01H 39/00

[52] U.S. Cl. ..... 200/61.08; 337/401

[58] Field of Search ..... 200/61.08, 154, 150 R; 337/401

[56] References Cited

U.S. PATENT DOCUMENTS 2,861,153 11/1958 Erk et al. ..... 200/61.08 X 2,892,062 6/1959 Bruckner et al. ..... 337/290

3,848,100 11/1974 Kozorezov et al. ..... 200/61.08

*Primary Examiner*—J. V. Truhe

*Assistant Examiner*—Morris Ginsburg

*Attorney, Agent, or Firm*—Burns, Doane, Swecker & Mathis

[57] ABSTRACT

A high-voltage, blast-actuated power switch is disclosed in which non-arcing edges are formed on a bridge conductor when the conductor is blasted. Upon blasting, the bridge conductor bends forming edges having a large radius of curvature. When the bridge conductor is blasted, an element of the bridge conductor moves in the axial direction away from the other element of the bridge conductor, thereby increasing the separation between bridge conductor elements. The axially movable bridge conductor is held in its new axial position causing the bridge conductor elements to remain separated.

15 Claims, 7 Drawing Figures

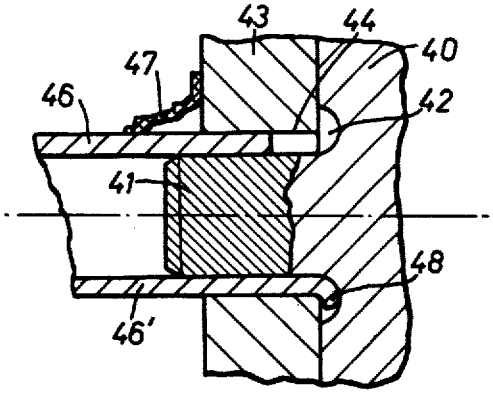
Fig. 4
Fig. 5
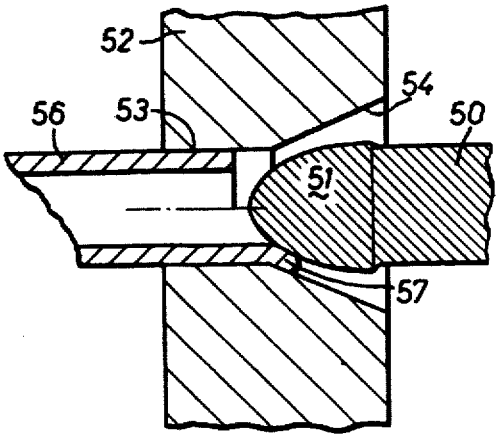
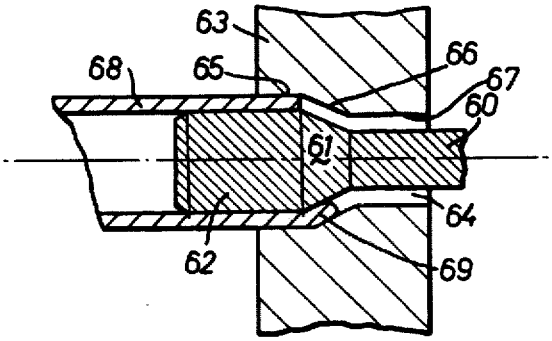
Fig. 6

HIGH-VOLTAGE, BLAST-ACTUATED POWER SWITCH HAVING A DEFORMABLE BRIDGE CONDUCTOR

BACKGROUND OF THE INVENTION

This invention relates generally to high-voltage power switches and more particularly to a high-voltage power switch that is actuated by blasting.

In power transmission and distribution systems, rapid current rises can occur, such as those occurring during short-circuit conditions. In order to protect the high-voltage power lines against the dynamic and thermal stresses which accompany the rapid current rises, the line must be electrically opened or cut-off before the short-circuit current has reached its peak value if the line is carrying alternating current, or before the line has reached its final value if the line is carrying direct current. The cut-off time required, which depends upon the frequency of the alternating current and on the inductance, capacitance and resistance of the power line, should not exceed a millisecond. Such rapid cut-off times, however, cannot be obtained with mechanically or magnetically actuated switches in medium-voltage and high-voltage networks. Therefore, switches have been developed which are actuated by blasting.

One conventional type of blast-actuated switch includes a hollow bridge conductor which electrically connects two external connections. A blasting cap is included in the hollow region of the conductor, approximately half way between each of the external connections. The blasting cap includes two wires which may be connected to an electric ignition device. The blasting cap is ignited, thereby blasting the conductor bridge with an explosive force. To prevent the scattering of fragments of the material which make up the bridge conductor at the time of blasting, the bridge is slotted in the longitudinal direction. Conductor webs, which are defined by the slots, each include a notch or a soldered joint at their longitudinal centers. Blasting the notches or soldered joints results in the webs being bent back to form rosettes around the associated external connection.

The energy stored within the inductance of the high-voltage power line will cause a step rise in voltage across the external connections when the bridge conductor is blasted. The voltage may rise to multiples of the operating voltage of the line. In order to prevent the rise in voltage across the separated ends of the bridge conductor from arcing and thereby delaying the cut-off process, a fusible wire is connected in parallel with the bridge conductor. The fusible wire is embedded in quenching sand. As soon as the rising voltage exceeds a predetermined value, the current flow through the fusible wire causes the wire to immediately melt, and the quenching sand prevents any further arcing. The fusible wire can be arranged and dimensioned so that the rise in voltage across the external connections is interrupted before the rising voltage reaches the breakdown potential of the gap between the separated ends of the bridge conductor. However, it has not been possible heretofore to prevent all arcing after the blasting of the bridge conductor in such conventional switches.

Arcing occurs in such conventional switches for primarily two reasons. First, the webs of the bridge conductor which are delineated by the slots have sharp edges. The edges become even more pronounced as a result of the blasting. After blasting, the density of the lines of flux and the gradient of the electrical field potential about the sharp edges will be very large in magnitude, thereby facilitating ionization of the gas contained within the switch casing. Second, the explosive force produced by the blasting caps used in such conventional switches is limited and therefore the axial extent to which the webs are bent back in rosette form by the explosion is also limited.

It is therefore an object of the present invention to provide a high-voltage, blast-actuated power switch in which the arcing which occurs in conventional switches after the bridge conductor has been blasted is more effectively prevented.

SUMMARY OF THE INVENTION

According to a preferred embodiment of the present invention, the high-voltage power switch has a casing including two electrically conductive external connections insulated from each other. The external connections are electrically connected by a bridge conductor inside the casing. The bridge conductor includes, at approximately its longitudinal center, a deformable region. According to one embodiment of the invention, the deformable region expands radially outwardly forming a torus-shaped outwardly bent edge on the bridge conductor when the conductor is blasted. According to another embodiment of the present invention, the deformable region contracts radially inwardly forming a torus-shaped inwardly bent edge on the bridge conductor when the conductor is blasted. The torus-shaped outwardly or inwardly bent edges of the conductor have a relatively large radius of curvature and therefore the density of the lines of flux and the gradient of the electric field potential will be low. As a result, ionization of the gas within the switch casing and arcing across the separated edges of the bridge conductor are eliminated.

According to a preferred embodiment of the present invention, the bridge conductor is arranged within the switch casing such that it is axially movable toward and within at least one of the external connections. As the bridge conductor is blasted, the conductor moves from a first axial position to a second axial position. Means are provided to hold the section of the bridge conductor that has moved to the second axial position in that new position. By so permitting the conductor bridge to move, the distance between the edges of the blasted bridge conductor is increased, further reducing the likelihood of gas ionization and arcing between the torus-shaped edges of the bridge conductor.

BRIEF DESCRIPTION OF THE DRAWINGS

The preferred embodiments of the present invention are described with reference to the accompanying drawings wherein like elements bear like reference numerals, and wherein:

FIG. 4, 5 and 6 are cross-sectional views illustrating apparatus for holding the bridge conductor in a second axial position.

Above the center lines of FIGS. 1, 2, 4, 5 and 6, the respectively illustrated elements of the present invention are depicted before the bridge conductor is blasted. Below the center lines of FIGS. 1, 2, 4, 5 and 6, the respective elements of the present invention are depicted after the bridge conductor is blasted.

Figure 2:
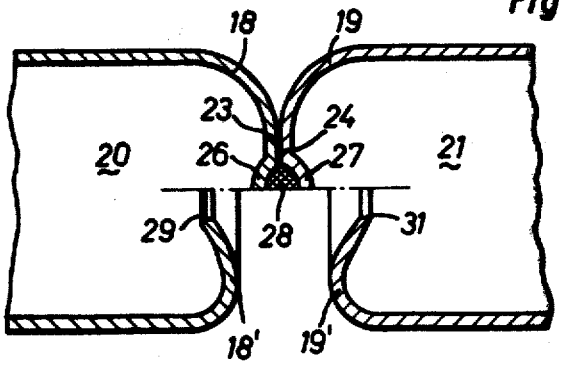
FIG. 2 is a cross-sectional view of a bridge conductor according to the present invention in which two sections of the bridge conductor are narrowed at their adjacent ends.
Figure 7:
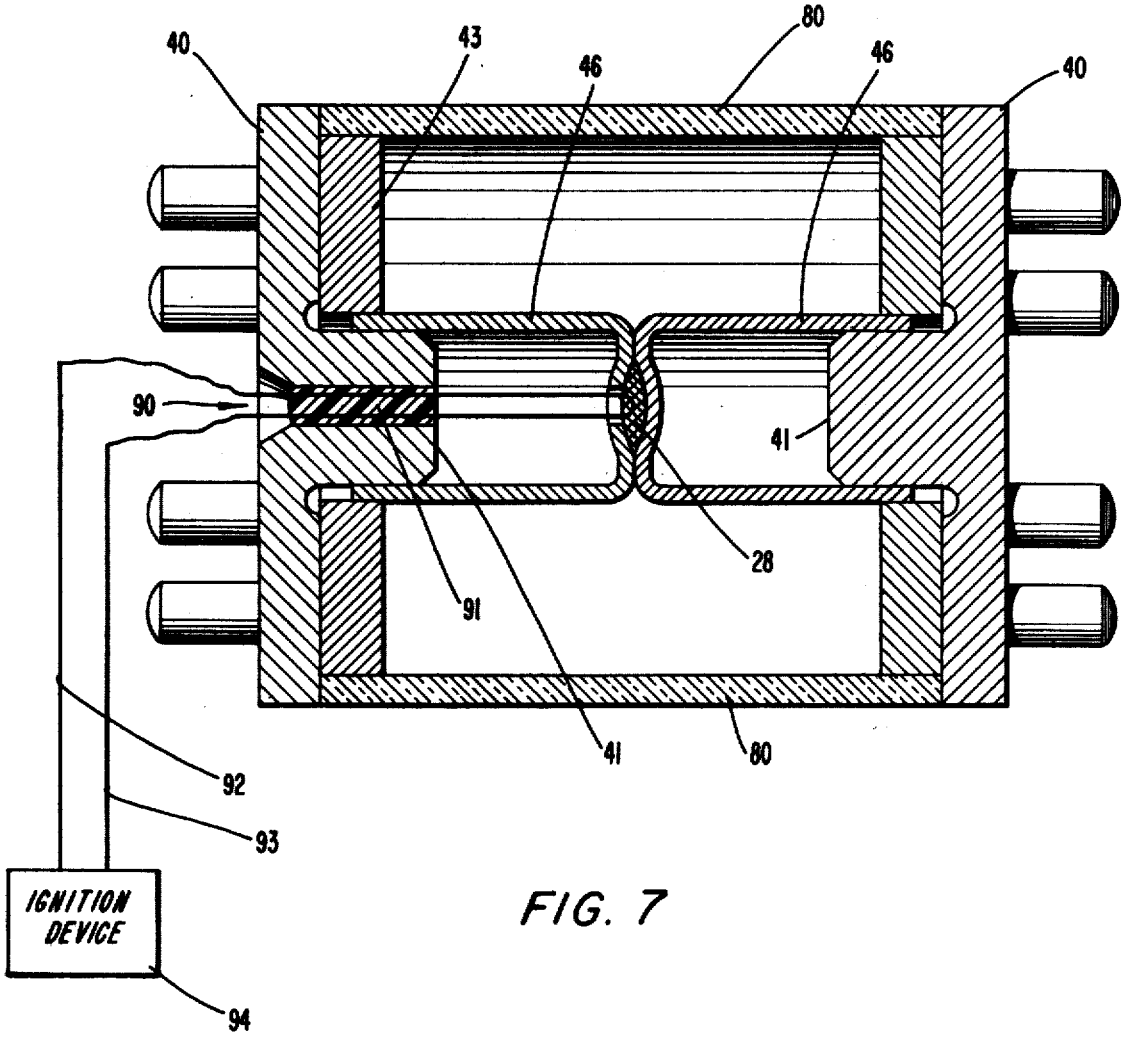

FIG. 7 is a schematic cross-sectional view of a blast-actuated power switch having external connections similar to that shown in FIG. 4 and incorporating a bridge conductor according to the present invention which is similar to that shown in FIG. 2.

DESCRIPTION OF THE PREFERRED EMBODIMENTS

Figure 1:
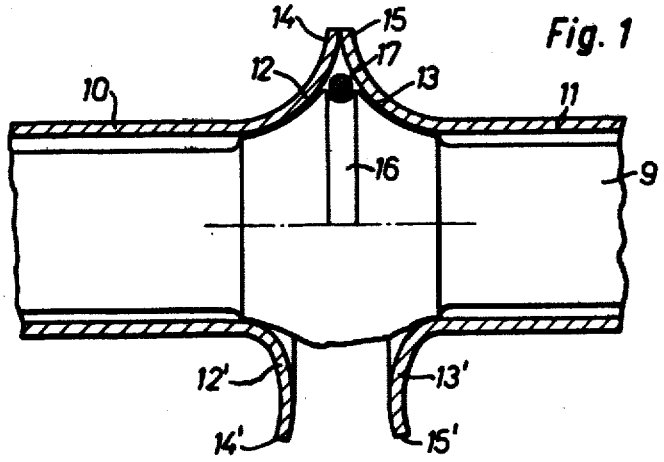
FIG. 1 is a cross-sectional view of a bridge conductor according to the present invention in which two sections of the bridge conductor are widened at their adjacent ends.

Referring to FIG. 1, a bridge conductor for a high-voltage, blast-actuated power switch includes two bridge elements 10,11. The bridge elements are tubular in form and coaxial with each other. An end 12 included on the bridge element 10 is adjacent to an end 13 included on the bridge element 11. The adjacent ends 12, 13 are widened in a cup-shaped manner, and each end 12, 13 includes a contact surface 14, 15, respectively. The widened ends of the two bridge elements may have a circular, an elliptical or a parabolic cross-section. The bridge elements are preferably made from a very ductile copper, for example OFHC-copper, which has a high electric conductivity and which will deform but not tear when subject to a relatively weak force. The contact surfaces 14, 15 can be soldered together, thereby further improving the electrical conductivity between the bridge elements 10, 11.

The bridge elements 10, 11 are slid over a core 9. The core 9 is made from an electrically insulating material, for example a ceramic. The core 9 includes a slot 16 which accommadates a circularly shaped blasting charge 17. Alternatively, the blasting charge may be included in the region of the contact surfaces 14, 15.

When the blasting charge 17 is exploded, the ends 12', 13' of the bridge elements 10, 11, respectively are bent backwardly and the contact surfaces 14', 15' are separated from each other as illustrated in the lower portion of FIG. 1. Thus blasting the bridge conductor deforms the adjacent ends of the bridge elements so as to form torus-shaped, radially outwardly bent edges or ends 12', 13' on the bridge conductor. Ends 12', 13' each have a relatively large radius of curvature and a smooth surface. As such, blasting the bridge conductor does not produce ends about which the density of the lines of flux and the gradient of the electric field potential are large in magnitude. Alternately, the bridge conductor of FIG. 1 may consist of a single bridge conductor element.

Referring to FIG. 2, a second preferred embodiment of the present invention includes a bridge conductor having bridge elements 20, 21. The bridge elements 20, 21 are bent inwardly and include ends 18, 19, respectively. The ends 18, 19 are adjacent to each other and include contact surfaces 23, 24, respectively at which the ends touch each other. In the middle of each contact surface 23, 24 a recess 26, 27, respectively is included. A blasting charge 28 is inserted into the space formed by the recesses 26, 27. The bridge elements are preferrably made of very ductile copper, for example OHFC-copper, which has a high electric conductivity and which will deform but not tear when subject to a relatively weak force. The contact surfaces 23, 24 may be soldered together.

When the blasting charge 28 is exploded, the contact surfaces 23, 24 are separated from each other and the ends 18', 19' are bent radially inwardly as illustrated in the lower portion of FIG. 2. Thus blasting the bridge conductor causes the deformable ends of the bridge elements to form torus-shaped, radially inwardly bent ends or edges or the bridge elements. The ends 18', 19' of the bridge elements each have a relatively large radius of curvature as well as a smooth surface. And, for all practical purposes, edges 29, 31 of the bridge elements 20, 21, respectively are located sufficiently far from the gap separating the bridge elements so that the edges do not affect the electric field in the gap.

Figure 3:
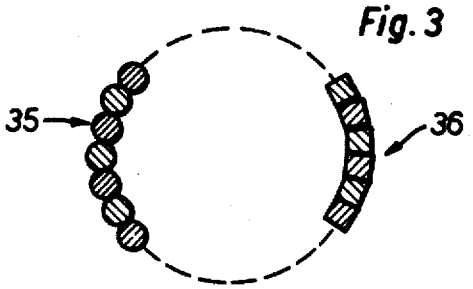
FIG. 3 is a cross-sectional view of a bridge conductor according to the present invention formed by longitudinally disposed, rod-shaped elements each having a circular or a quadrangular cross-section.

FIG. 3 is a cross-sectional view of a bridge conductor which includes several rod-shaped elements arranged in the longitudinal direction. Elements 35 each have a substantially circular cross-section and are therefore in contact with each other only along a very narrow region. Elements 36 each have a substantially quadrangular cross section which is slightly trapezoidal and which includes rounded edges. The elements 36, therefore, are in contact with each other along a relatively broad area.

Rod-shaped elements 35 or 36 may be used to form the bridge elements illustrated in FIGS. 1 and 2 rather than the simple hollow cylindrical elements illustrated therein. In the case of a bridge element with a widened end as illustrated in FIG. 1, the rod-shaped elements are placed at a distance from each other within the widened region. Alternatively, rod-shaped elements are used which are thicker in this region of widening so that the rod-shaped elements will be in close contact with each other in the tubular region as well as in the widened region of the bridge conductor. In the case of a bridge conductor with a narrowed end as illustrated in FIG. 2, the cross section of the rod-shaped elements can taper off gradually from the beginning of the contraction up to the recesses 26, 27.

Bridge conductors which are formed by rod-shaped elements can be blasted apart and respectively separated from one another by a lower explosive than is necessary with a single-piece bridge conductor or with two bridge conductor elements.

The rod-shaped elements can be soldered together in the region adjacent to the external connections along the regions of contact between the rod-shaped elements. The rod-shaped elements should not, however, be soldered within the region of expansion or contraction in order to avoid the formation of sharp edges when the elements are blasted.

According to a preferred embodiment of the present invention, the bridge conductor is movable mounted within the switch casing such that the bridge conductor is axially movable toward and within at least one of the external connections. As the bridge conductor is blasted, the bridge conductor moves toward the at least one external connection, moving from a first axial position to a second axial position. By so moving, the ends created on the bridge conductor by the blast are further separated from each other. This further reduces the likelihood of arcing between the separated ends of the bridge conductor. FIGS. 4, 5 and 6 illustrate various apparatus which cause the moving bridge conductor to be locked in the second axial position. Above the center line of each figure the bridge conductor is illustrated in the first axial position, and below the center line the bridge conductor is illustrated locked in the second axial position.

FIG. 4 illustrates a movably mounted tubular bridge element 46 mounted within an external connection 40. The external connection 40 has a projecting plug 41 and an annular cut-out or recess 42. The smaller or inner diameter of the recess 42 is equal to the outer diameter of the plug 41. The surface of the external connection 40 is covered by a plate 43 which has a bore 44 that extends coaxially about the plug. The tubular bridge element 46 is accommodated in the annulus between the outer diameter of the plug and the inner diameter of the bore. The tolerances for the fit are selected such that the electrical resistance between the plug and the plate and between the plug and the bridge element is as low as possible while still allowing the bridge element to move in the axial direction under a relatively weak force. The electrical resistance can be further lowered by connecting the bridge element 46 to the plate 43 by a flexible copper strip 47.

When a bridge conductor having a bridge element as illustrated in FIG. 4 is blasted, the explosion not only separates the contact surfaces but also causes the bridge element to move in the axial direction. The bridge element 46' is illustrated in the lower half of FIG. 4 in its second axial position. An end of the bridge element is deformed by the recess 42 so as to form a bead 48. The bead tends to hold the bridge element in the second axial position, preventing the bridge element from moving back to the first axial position, thereby insuring that the blasted contact surfaces remain separated.

FIG. 5 illustrates a movably mounted tubular bridge element 56 mounted within an external connection. The external connection includes a plug 50 which has a rounded top 51, and a cover plate 52 which has a bore 53. The diameter of the bore 53 is smaller than the greatest diameter of the rounded top 51. The bridge element 56 is accommodated in the bore 53 in the same manner that the bridge element 46 was accommodated in the plate 43 of FIG. 4. The portion of the bore which faces the plug 50 widens into a cone 54. The rounded top 51 of the plug 50 is introduced into the cone 54 to such an extent that the distance between the wall of the cone and the nearest part of the top 51 is greater than the wall thickness of the bridge element 56 inserted into the bore.

When the bridge conductor is blasted, the bridge element 56 moves in the axial direction onto the top 51 of the plug 50. This results in the free end 57 of the bridge element 56 being deformed in a funnel-shaped manner as illustrated in the lower portion of FIG. 5. So deformed, the bridge element 56 is prevented from moving back to the first axial position.

FIG. 6 illustrates a movably mounted tubular bridge element 68 mounted within an external connection. The external connection includes a plug 60 which includes a tapered piece 61 and a cylindrical end piece 62. The diameter of the cylindrical end piece 62 is greater than that of the plug 60. The external connection also includes a cover plate 63 having a stepped cut-out 64. The cut out 64 includes a first bore 65, a taper 66 and a second bore 67. The first bore 65 has a diameter greater than the second bore 67. The plug is introduced into the cut-out 64 to such an extent that the distance between the wall of the cut-out and the adjacent plug is uniform throughout. The bridge element 68 is slid over the end piece 62 of the plug and into the bore 65 of the cut-out. The bridge element 68 is movable in the axial direction, and the electrical resistance between the plug 60 and the bridge element 68, and between the cover plate 63 and the bridge element 68 are negligible low.

When the bridge conductor is blasted, the bridge element 68 moves in the axial direction. A free end 69 included on the bridge element 68 is deformed between the taper 66 and the tapered piece 61 of the plug as illustrated in the lower portion of FIG. 6. So deformed, the bridge element 68 is prevented from returning to the first axial position.

Referring to FIG. 7, it will be appreciated by those of ordinary skill in the art that the bridge conductor of the present invention forms a part of a power switch comprising a conventional casing 80 supporting two electrically conductive external connections 40 which are electrically connected by the bridge conductor mounted therebetween, but which are otherwise electrically insulated from each other. As is conventional, electrical leads 92 and 93 are provided which connect blasting charge 28 to an externally located electric ignition device 94. As will be appreciated by those of ordinary skill in the art, a bore 90 advantageously is provided in one of the electrical connections 40 through which leads 92 and 93 pass, and bore 90 advantageously is sealed, as shown, with any appropriate conventional insulating material 91.

Switches having conductor bridges as described herein can be suitable shaped and dimensioned such that the switch can be used in various voltage and current capacities.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Moreover, variations and changes may be made by those skilled in the art without departing from the spirit of the present invention.

What is claimed is:

1. A high-voltage, blast-actuated power switch having a hollow switch casing and having first and second external electrical connections, said first and second external connections being electrically insulated from each other, said switch comprising:

a bridge conductor included within said switch casing, said bridge conductor electrically connecting said first external connection to said second external connection and comprising:

a first conductor element, said first element being electrically connected to said first external connection, and said first element terminating at a first end; and a second conductor element, said second element being electrically connected to said second external connection, and said second element terminating at a second end;

wherein said first and second ends are bent radially outward from said first and second conductor elements, respectively; and wherein said first and second ends form a single contact surface at which said first and second conductor elements are electrically and physically connected to each other;

blasting means included within said switch casing for blasting said bridge conductor so as to electrically disconnect said first external connection from said second external connection;

wherein said bridge conductor includes a deformable region, said region forming a torus-shaped, radially outwardly bent edge on said bridge conductor when said bridge conductor is blasted by said blasting means.

2. A high-voltage, blast-actuated power switch having a hollow switch casing and having first and second external electrical connections, said first and second external connections being electrically insulated from each other, said switch comprising:

a bridge conductor included within said switch casing, said bridge conductor electrically connecting said first external connection to said second external connection; and blasting means included within said switch casing for blasting said bridge conductor so as to electrically disconnect said first external connection from said second external connection;

wherein said bridge conductor includes a deformable region, said region forming a torus-shaped, radially inwardly bent edge on said bridge conductor when said bridge conductor is blasted by said blasting means.

3. The switch according to claim 1 or claim 2 wherein said blasting means is ignited externally from said switch casing.

4. The switch according to claim 1 or claim 2 wherein said deformable region is located approximately at the longitudinal center of said bridge conductor.

5. The switch according to claim 2 wherein said bridge conductor comprises:

a first conductor element, said first element being electrically connected to said first external connection, and said first element terminating at a first end; and a second conductor element, said element being electrically connected to said second external connection, and said second element terminating at a second end;

wherein said first and second ends are bent radially inward from said first and second conductor elements, respectively; and wherein said first and second ends form a single contact surface at which said first and second conductor elements are electrically and physically connected to each other.

6. The switch according to claim 1 or claim 5 wherein said first and second conductor elements each include a rod-shaped element, said rod-shaped element having a substantially circular cross-section.

7. The switch according to claim 1 or claim 5 wherein said first and second conductor elements each include a rod-shaped element having a substantially quadrangular cross-section, said substantially quadrangular cross-section including rounded edges.

8. The switch according to claim 1 wherein said first and second conductor elements each include a hollow region, said hollow regions being coaxial with each other; and wherein said switch further comprises a core element, said core element being made from an electrically insulative material, and said core element being accommodated within said hollow regions of said first and second conductor elements; and wherein said blasting means comprises a blasting charge, said blasting charge being accommodated by said core element, and said blasting charge being located in the vicinity of said first and second ends of said first and second conductor elements.

9. The switch according to claim 5 wherein at least one of said first and second ends of said first and second conductor elements includes a recess; and wherein said blasting means comprises a blasting charge, said blasting charge being accommodated by said recess.

10. A high-voltage, blast-actuated power switch having a hollow switch casing and having first and second external electrical connections, said first and second external connections being electrically insulated from each other, said switch comprising:

a bridge conductor included within said switch casing, said bridge conductor electrically connecting said first external connection to said second external connection; and blasting means included within said switch casing for blasting said bridge conductor so as to electrically disconnect said first external connection from said second external connection;

wherein said bridge conductor includes a deformable region, said region forming a torus-shaped, radially bent edge on said bridge conductor when said bridge conductor is blasted by said basting means;

wherein said bridge conductor is movably mounted within said switch casing such that said bridge conductor is axially movable toward and within at least one of said first and second external connections, said bridge conductor moving from a first axial position to a second axial position when said bridge conductor is blasted by said blasting means; and wherein said switch further comprises holding means for holding said bridge conductor in said second axial position.

11. The switch according to claim 10 wherein said holding means includes an annular recess, said recess being located in said at least one of said first and second external connections, and said recess being substantially coaxially disposed about said bridge conductor.

12. The switch according to claim 10 wherein said holding means includes a recess, said recess being located in said at least one of said first and second external connections, said recess being substantially coaxially disposed about said bridge conductor, and said recess having a cross-sectional area which is varied in the direction of axial movement of said bridge conductor.

13. The switch according to claim 12 wherein the cross-sectional area of said recess is decreased in the direction of axial movement of said bridge conductor.

14. The switch according to claim 12 wherein the cross-sectional area of said recess is increased in the direction of axial movement of said bridge conductor.

15. The switch according to claim 12 wherein said recess is situated between a bore and a plug element, said bore being located in said at least one of said first and second external connections, and said plug element being disposed upon said at least one of said first and second external connections and said plug element at least partially penetrating said bore.

* * * * *